United States Patent [19]

Young, III

[11] Patent Number: 4,607,792

[45] Date of Patent: Aug. 26, 1986

[54] OSCILLATING PULSED JET GENERATOR

[76] Inventor: Chapman Young, III, P.O. Box 1173, Steamboat Springs, Colo. 80477

[21] Appl. No.: 566,350

[22] Filed: Dec. 28, 1983

[51] Int. Cl.[4] ..... E21B 7/18

[52] U.S. Cl. ..... 239/101; 175/422 R

[58] Field of Search ..... 239/101, 102, 93, 97; 175/422

[56] References Cited

U.S. PATENT DOCUMENTS

| | | | |
|---|---|---|---|
| 3,343,794 | 9/1967 | Voitsekhovsky | 239/101 |
| 3,520,477 | 2/1968 | Cooley | 239/101 |
| 3,841,559 | 10/1974 | Hall et al. | 239/101 |
| 3,897,836 | 8/1975 | Hall et al. | 239/101 X |
| 3,905,552 | 9/1975 | Hall et al. | 239/101 |
| 4,079,890 | 3/1978 | Lyatkher et al. | 239/101 |
| 4,195,885 | 4/1980 | Lavon | 239/101 X |

FOREIGN PATENT DOCUMENTS 75105569 1/1978 Sweden .

*Primary Examiner*—Joseph F. Peters, Jr.
*Assistant Examiner*—Kevin Patrick Weldon
*Attorney, Agent, or Firm*—Hugh H. Drake

[57] ABSTRACT

A device generates pulsed liquid jets through a cumulative nozzle at high repetition rates by using a controlled oscillatory motion of the nozzle assembly coupled with the inertia of the water package and a piston to effectively evacuate the nozzle prior to generation of each jet pulse. The cumulative nozzle can be of any form, such as exponential, hyperbolic, cissoid, etc. Forward motion of the nozzle assembly serves to empty the nozzle of liquid residual therein from the previously generated jet. That forward motion also positions the residual liquid, freshly added liquid and a liquid accelerating piston for the generation of the next subsequent pulse. At the end of the forward motion stroke, the liquid and accelerating piston are rapidly accelerated into the nozzle by means of a high pressure gas. The high pressure gas can be derived from any usual source such as a compressor, a gas generating propellant, the combustion of a fuel or by the rapid compression of a driving gas through the use of a second piston of considerably greater mass than the liquid accelerating piston. The jet pulses obtained are at a repetition rate up to several pulses per second and can be used to cut and break hard materials such as rock, ceramic and concrete.

10 Claims, 8 Drawing Figures

OSCILLATING PULSED JET GENERATOR

The present invention relates to an oscillating pulsed jet generator. More particularly, it pertains to the generation of liquid jet pulses through a cumulative nozzle at high repetition rates.

Especially in the last decade or two, numerous devices and techniques have been published for use in connection with the generation of high-pressure liquid jets. Those jets typically have used water as the jetted liquid, and the devices are either of the continuous or quasi-continuous type, with the liquid being injected through a nozzle by means of a high pressure intensifier, or they have been of the truly pulsed jet type wherein a jet of short duration is generated by unsteady acceleration of a liquid injected into a previously empty nozzle of a special form.

An early effort in the field is described in British Pat. No. 1,109,286-Voitsekhovsky and U.S. Pat. No. 3,343,794. Since then, considerable effort has been devoted to the design and utilization of the special nozzle shapes required for jet generation by use of an unsteady acceleration process. During the same time period, attention also has been given to the development of techniques for using such jets effectively to break or cut highly resistant material. Special effort has been made for the purpose of utilizing pulsed type jets for the breaking and drilling of rock and rock-like material. Although continuous type jets, which must of necessity operate at lower jet cutting pressures, can be used to cut rock, their efficiency has restricted their utilization to special applications only. Representative approaches are described by Frank, J. N., Fogelson, D. E. and Chester, J. W., "Hydraulic Mining in the U.S.A.", *Proc. First Intl. Symp. on Jet Cutting Tech.*, Coventry, England, BHRA, 1972, and Summers, D. A., "Water Jet Cutting Related to Rock Properties", *Proc.* 14th *Symp. on Rock Mech.*, June, 1972, pp. 559–588, American Society of Civil Engineering, New York, 1973.

In terms of energy utilized per unit of rock broken out, the pulsed-type jets can be used to efficiently break the hardest of materials including rock; Cooley, W. C., "Performance and Noise Supression Tests of a Water Cannon", *Report FRA-ORD & D*, No. 75-9, September 1974 and Young, C., "Rock Breakage with Pulsed Water Jets, presented ASME—Energy Technology Conference, Houston, TX, ASME Pub. 77-PET-78, September 1977 (hereinafter referred to as "Young 1977"). With special techniques and methods, such as outlined by Young, C., Denisart, J.P. and Edney, B., "Method and Device for Breaking Hard Compact Material Such as Rock", Swedish Pat No. 7,510,556-9 of Jan. 5, 1978, and in Young 1977, the specific energy for rock breakage can be significantly less than that required for the traditional drill and blast technique. One of the biggest limitations in the pulsed jet techniques for rock breakage derives from the fact that the jetting liquid must be injected at a moderate velocity into a previously empty nozzle of special form.

With the exception of the high-speed rotating nozzle technique described in U.S. Pat. No. 3,883,075—Edney and an expanding chamber described in U.S. Pat. No. 3,841,559—Hall et al, or the provision of valving to permit the nozzle to be blown dry as in U.S. Pat. No. 3,905,552—Hall et al, the approaches discussed do not permit a rapid emptying of a nozzle after the generation of one pulsed jet and prior to the generation of a second.

While the Edney technique has the possibility of generating pulsed jets at a very high frequency, the peak velocity and diameter of the jets are severely limited. Also, it has been necessary with the other approaches to hold the jetting liquid in position at or near the entrance to the nozzle prior to its rapid acceleration through the nozzle by means of seals, membranes or diaphrams which must be replaced for each successive operation of the pulsed jet device. Reliance upon air to remove the residual liquid may also lead to cavitation that would cause the emptying of the nozzle to be ineffective or, at least, incomplete.

Because of the technical and mechanical problems associated with emptying the nozzle and properly positioning the package of liquid for the generation of each successive jet, current techniques have been limited to being able to fire a pulsed jet at a repetition rate of only a few jets per minute. Although the specific energy for rock breakage has been shown by Young (1977, above) to be both reasonable and technically attractive, the slow repetition rates of at least most of the techiques mentioned have reduced the rate at which rock may be broken to levels that often are found to be unacceptable.

It is, therefore, a general object to the present invention to provide a new approach which overcomes limitations and deficiencies in the prior art such as those discussed above.

A more specific object of the present invention is to provide devices which enable rapidly emptying the nozzle after the generation of each successive jet pulse and properly positioning the liquid package to be jetted so that pulsed-type jets are capable of being generated at significantly higher repetition rates than has usually been the case.

Another object of the present invention is to provide an approach which enables a variety of alternatives in terms of manner of fabricating and arranging the jet pulse generating assembly.

As constructed in accordance with the present invention, one embodiment of an oscillating pulsed jet generator includes an elongated launch tube. A cumulative nozzle is coupled to one end of that tube and projects away therefrom, the launch tube being closed at its other end. A piston is slideable longitudinally within the launch tube. An elongated accelerating tube ensleeves the launch tube and accomodates limited sliding movement of the launch tube and the nozzle therewithin. A reservoir contains a gas under a pressure sufficient to accelerate the piston within the launch tube toward the nozzle. The generator assembly includes means for selectively admitting the gas into the launch tube behind the piston from the nozzle. Finally the assembly includes means for moving the launch tube and the nozzle within the accelerating tube.

The features of the present invention which are believed to be patentable are set forth with particularity in the appended claims. The organization and manner of operation in the invention, together with further objects and advantages thereof, may best be understood by reference to the following description taken in connection with the accompanying drawings, in the several figures of which like reference numerals identify like elements, and in which:

As the name implies, the approach involves an oscillating pulsed-jet generator which operates in a cyclic manner. The several mechanical actions necessary for successful generation of pulse-type jets are carried out at the appropriate moments during each cycle of operation of the overall device. The six most important positions or operations characteristic of a single cycle are shown diagramatically in FIGS. 1–6. Because all of the operations necessary for successful pulse jet generation are carried out in a cyclic and continuous fashion, the approach enables the generator to operate at a rate as high as several cycles per second.

Figure 1:
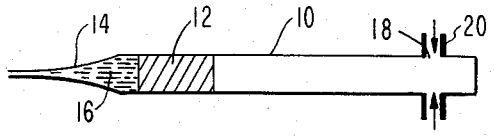
FIGS. 1–6 are schematic diagrams of an oscillating pulsed-jet generator, the different figures in succession showing respective different positions of the components at different times during one complete cycle of operation.

In FIG. 1, an elongated tube 10 slideably carries a piston 12 and terminates in a nozzle block 14 in which is contained a residual portion or package 16 of water or other cutting liquid left from the preceding action of the device. Near the rearward end of tube 10 is a lateral opening 18. A port 20, in the position shown in FIG. 1, is aligned with opening 18. Port 20 is fed from a high pressure source or reservoir of gas. A pair of openings 18 are indicated, although there may be any number. There may be a matching plurality of ports 20 or a single port 20 may surround tube 10.

Also included in the overall assembly, but for clarity not shown in FIGS. 1–6, are means for moving the entire combination of launch tube 10 and nozzle 14 back and forth, or to the left and right as represented in FIGS. 1–6. While suitable accelerating means for that purpose are shown later, the means for accelerating or moving the launch tube and its components may be any of hydraulics, mechanics or electromagnetics.

FIG. 1 shows tube 10 and its components in their most forward position just after firing of the pulsed jet has been completed. At this point, nozzle 14 is in close proximity to whatever material is being cut or broken, and residual water package 16 and piston 12 are located in or near nozzle 14. This is the same component situation which exists after the single shot operation of more conventional jet generating devices such as those described by the Cooley publication above mentioned and as also included in Young 1977.

Figure 2:
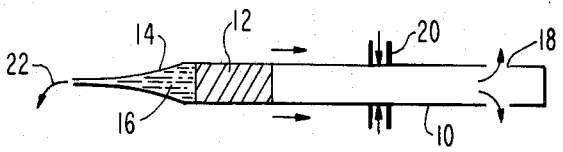

The next successive position in a typical operating cycle is shown in FIG. 2. Nozzle 14 and piston 12 along with launch tube 10 have been displaced in a direction to the rear or away from the material that was being cut, a direction which is the opposite of that in which piston 12 has been accelerated in the previous cycle. The acceleration and velocities experienced by nozzle 14 and tube 10 during the rearward movement is comparatively low with a peak velocity of less than twenty meters per second. This simplifies any mechanical or other engineering problems that might otherwise arise. By reason of the rearward acceleration of nozzle 14 and the inertia of residual water package 16 and piston 12, some but not all of the liquid remaining in nozzle 14 is ejected at a very low velocity through nozzle 14 as indicated by arrow 22. That ejected liquid is a minor loss which must be replaced at a later time in a typical operating cycle.

Two important aspects of the return cycle are also shown in FIG. 2. Because of the rearward displacement of launch tube 10, port 20 has been closed, thus preserving any high pressure gas that may be still residing in a reservoir or equivalent gas storage system that feeds port 20. Simultaneously, opening 18 has been exposed to the ambient atmosphere, thus permitting any gas remaining in tube 10 to be rapidly exhausted. It will be noted that, because of the way that port 20 is opened and closed, only the gas remaining in launch tube 10 is lost with each cycle, while that in a reservoir system is conserved.

Figure 3:
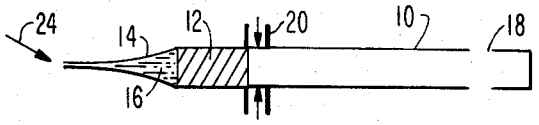

The rearward-most position of the device is represented in FIG. 3. At that point in the cycle, the pressure acting within tube 10 has fallen to that of the ambient atmosphere, and the high pressure gas supply system is still isolated from tube 10. At this time, that system may be recharged to whatever pressure is desired for a subsequent launching of piston 12; that is, recharge may begin as soon as port 20 is closed. With the device in the position of FIG. 3, piston 12 and residual water package 16 are still located in their closest proximity to nozzle 14. Under certain operation conditions, it may also be necessary at this point, or at least desirable, to inject into the nozzle area additional jetting liquid which will be needed for the subsequent jet generating cycle.

Figure 4:
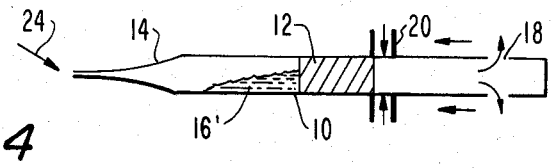

A most important step in the overall operation is shown in FIG. 4. At that time, launch tube 10 is being rapidly accelerated forwardly toward the face of the material to be subsequently impacted by the pulsed-type jet. In this forward cycle, the acceleration and velocity that are required for proper functioning are still within a regime that permits utilization of conventional movement techniques, peak acceleration being less than two-hundred G and peak velocity being less than twenty meters per second. The charge of additional liquid is injected into the nozzle only during a portion of the forward acceleration cycle of the launch tube by virtue of the positioning of the jetting liquid source 24. The important feature shown in FIG. 4 is the effect of inertia of the jet generating liquid 16' and piston 12. Because of their inertia, the liquid and the piston remain essentially stationary in space while launch tube 10 is accelerated past them. The most direct result of this action is to empty nozzle 14 of any liquid which had been resting therein from the previous cycle or from the subsequent injection of make-up liquid while the device was at its rearward-most position of FIG. 3.

A second effect of the rapid forward motion of nozzle 14 and tube 10 is to create a partial vacuum in tube 10 between the exit of nozzle 14 and piston 12. This partial vacuum is desirable for the successful generation of a high-quality pulsed jet when the piston and water package are subsequently accelerate into the nozzle. The quality of this partial vacuum may be improved as desired by either mechanically closing off the nozzle exit orifice during the forward accelerating cycle portion or by providing a stream of the jetting liquid as indicated by arrow 24 on the exterior of that exit such that the higher viscosity of the liquid, relative to air, acts as a fluid plug at the nozzle exit. Of course, some of that liquid is drawn into the launch tube and, when combined with the fluid already therein, serves as a source of the jetting liquid which must be added to the system at each cycle.

Figure 5:
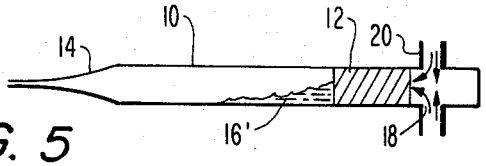

The relative positions of the components at the end of the forward-motion cycle are shown in FIG. 5. At the moment that nozzle 14 and tube 10 arrive in their most forward position, port 20 of the high pressure source is aligned with opening 18 in launch tube 10 in a location just behind piston 12. This alignment of port 20 and opening 18 provides for the rapid introduction of the high-pressure accelerating gas into tube 10, so as to rapidly accelerate piston 12, and consequently package 16' of the jetting liquid, toward non-empty nozzle 14. Because of the partial vacuum existing in tube 10, and because of the high inertia of the liquid package, the liquid is collected as a solid cylindrical fluid package on the front of the rapidly-accelerating piston. At the end of the piston-accelerating cycle, package 16 is injected into the empty nozzle exactly as is currently done for jet generating devices using the unsteady acceleration cummulative nozzle principle.

Figure 6:
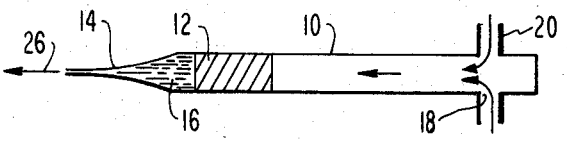

As can be seen in FIG. 6 at the ending of the cycle, the unsteady acceleration of the rapidly moving package of jetting liquid in the cumulative nozzle results in the generation of the high quality pulsed liquid jet as represented by the arrow 26. Since the assembly is in its forward-most position at this instant, it is possible to have the nozzle exit in very close proximity to the surface to be struck by the liquid jet. Therefore, the energy in the jet is most effectively utilized to effect the desired material cutting, fracturing or destruction.

Instantly after a pulsed jet has been generated by the sequence of operations shown in FIGS. 1–6, the oscillating jet assembly is in such a position that a return cycle can be immediately commenced. Based upon experiments and supporting calculations for a device having a launch tube of twenty-five millimeters inside diameter and a one and one-half meter length, the characteristic times for various operations are as follows: return cycle is two-hundred milliseconds, injection of additional jetting liquid takes one-hundred milliseconds, the forward acceleration time is one-hundred milliseconds and the forward acceleration of the piston and jetting liquid package takes ten milliseconds. Since the total of those times is less than five-hundred milliseconds, it is evident that any device of those dimensional characteristics is capable of operation at a repetition rate as high as two cycles per second. In practical operation, repetition rates in the range between one and one-tenth cycle per second are employed.

In an effort to more fully evaluate the principles and proper manner of operation, and thereby afford guidance in the design of various alternative embodiments, several experiments have tested certain aspects. One area investigated was the possibility of failing to accumulate and maintain on the front of piston 12 an appropriately configured package of the jetting liquid. If high-pressure air or other gas is used as the accelerating media for the piston, it is conceivable that some of that gas could escape past the piston, become mixed with the jetting liquid and destroy the properties of the liquid or its cylindrical geometry, so that good jet generation would not be realized.

In testing that aspect, a forty-two millimeter inside-diameter launch tube of Plexiglass was used together with a plastic piston of Ertalon, and several different geometries of pistons were accelerated in that launch tube, so as to accumulate and maintain on their front the required liquid package. Using accelerating gas pressures ranging between fifty and two-hundred bars, final piston velocities as high as two-hundred-fifty meters-per-second were realized after travel distances as great as one meter. High-speed photography was used to observe the water package at various stages of its acceleration. For almost all accelerating conditions and quite independently of the nature of the accelerating piston, the type of seals provided thereon, and the presence of joints in the launch tube, the quality of the liquid package was found not to be disturbed by any high-pressure gas escaping past the piston. It is believed that the high-pressure accelerating gas is precluded from escaping past the piston due to the dynamic forces of a boundry layer developed in the accelerating liquid package in front of the piston. In any event, it appears that the escape of the accelerating gas around the piston and into the liquid package poses no problems in various forms of practical development.

Another aspect of the functional operation of the assembly involves the emptying of the nozzle during the rapid forward acceleration of the nozzle and launch tube assembly during the condition illustrated by FIG. 4. The phenomena and potential problems of nozzle emptying were investigated by using a transparent nozzle and launch type accelerated in a forty-two millimeter diameter accelerating tube. The launch tube had outside and inside diameters of forty and thirty millimeters, respectively. A nozzle, having an approximately exponential form such as is commonly utilized in jet-generating devices, was fabricated from an epoxy casting resin, using an appropriately shaped Teflon mold which was placed within one end of the launch tube. The mold was removed once the resin had hardened. Pistons of steel, aluminum and PVC were tried. The pistons were positioned in the launch tube so that the end of the piston was approximately thirty millimeters from the entrance to the taper in the nozzle section. Subsequently, the space between the piston and the nozzle section and within the nozzle itself was filled with water stained so as to be visible to high-speed color photography. In some experiments, a cup fabricated at the exit end of the nozzle was filled with a different-colored water so as also to be visible to the photography.

Using driving pressures ranging from five to ten bars, the nozzle and launch tube assembly was accelerated to velocities as high as fifteen meters per second. The high-speed photography permitted visual observation of the emptying of the nozzle section and the quality of the jetting-liquid package during the forward acceleration of the nozzle and launch tube assembly. These experiments demonstrated that there appeared to be no technical or engineering problems to be associated with the emptying of the nozzle by such a rapid forward acceleration and that the water package finally formed on the front of the jet generating piston was of consistantly high quality.

As a result of the conclusions which could be drawn from the successful experiments discussed above, it was possible to continue the calculation and design efforts required to define more exactly the details and operating characteristics of a complete oscillating pulsed jet generator. Such engeineering details and operating characteristics of one device working on the oscillating principle led to that which is shown in FIG. 7.

Figure 7:
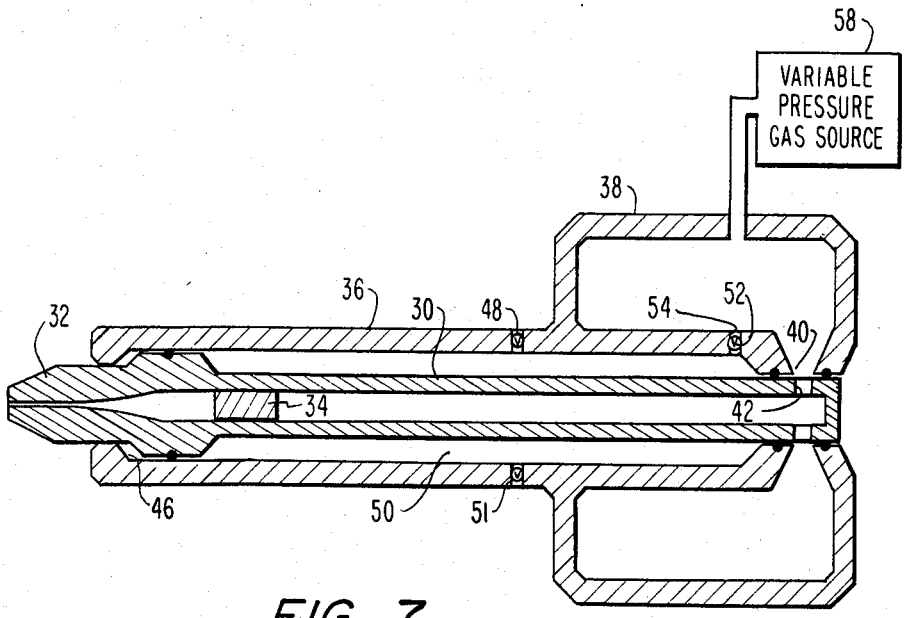
FIG. 7 is a partially diagramatic cross sectional longitudinal view of one specific embodiment of an oscillating pulsed-jet generator.

The oscillating pulsed jet generator of FIG. 7 employs the same sequence of operations summarized with respect to FIGS. 1–6. For the sake of clarity, some of the simpler and completely-conventional valving, however, is not illustrated in FIG. 7, or at most is only schematically represented. Again, the principal component is a launch tube 30 which, in this case, is formed integrally with nozzle block 32, and a piston 34 slides within tube 30. Tube 30 and nozzle 32 slide freely within an accelerating tube 36 upon the rear end of which is affixed a high-pressure gas reservoir 38 that surrounds tube 30. The illustrated seals may not even be needed, but, in any event, they are not sufficiently tight to inhibit relative movement. Reservoir 38 has an exit port 40 which is aligned at the appropriate moment with openings 42 near the rear end of launch tube 30. The launch tube and nozzle contain only the piston and the liquid package. As before, the position of the package of liquid and of the piston are controlled entirely by their inertia and the high-pressure gas which is used to accelerate them into the nozzle block.

As shown in FIG. 7, the components are in their positions at the instant of jet generation, with the nozzle and launch tube at their forwardmost location. For that condition, openings 42 of tube 30 have been aligned with exit port 40 of reservoir 38, allowing for the rapid forward acceleration of the piston and liquid package that has just occured.

Preferably, either a gas or an other energy absorbing fluid is contained in a cavity 46 between nozzle 32 and the forward end of accelerator tube 36. That particular gas or other fluid becomes pressurized as tube 36 is approached by nozzle 32 and serves both to stop the forward motion of the combined nozzle and launch tube unit as well as subsequently to accelerate that unit in the rearward direction.

Prior to that rearward acceleration, the pressurized accelerating gas, that had been used for forward acceleration, is vented to atmospheric pressure by means of conventional valving as at 48. Under the action of at least their own inertia, nozzle 32 and launch tube 30 continue in a rearward direction until the device is in the ready position corresponding to FIG. 3. Such rearward motion may be assisted by mechanical or hydraulic means. An example is to create a partial vacuum within the chamber 50 defined between tubes 30 and 36 through valve 48 or through a separate valve as at 51. During that rearward motion, port 40 from high-pressure reservoir 38 is closed and openings 42 in tube 30 are open to atmospheric pressure, thus rapidly venting the launch tube to ambient atmospheric pressure.

When the nozzle and launch tube unit is in the ready position, an additional quantity of jetting liquid is added to the liquid package as needed either through the exit of nozzle 32 or through internal hydraulic circuitry not illustrated. A quantity of the pressurized accelerating gas in reservoir 38 then is caused to communicate through a valve 52, so as to enter into the volume of chamber 50 which surrounds tube 30. As the pressure is developed within chamber 50, it serves to start the forward acceleration cycle. Again during that forward acceleration, the rear of tube 30 is maintained at ambient atmospheric pressure, since openings 42 are still vented. At the same time, piston 34 and the jetting-fluid package are held in space by their inertia to allow tube 30 to slide or pass over them.

As before, the rapid acceleration of the nozzle and launch tube creates a partial vacuum ahead of the inertially-held piston and liquid package. When entrance port 40 becomes aligned with openings 42, the high-pressure reservoir gas is applied to the rear of the piston, thus providing for its rapid forward acceleration as discussed earlier. Valves 48, 51 and 52, which control the application of fluid pressure to chamber 50, are only schematically represented, since their function and performance requirements are conventional and routine.

The very rapid valving, provided by the alignment of entrance port 40 with openings 42, effects acceleration of piston 32 to a value as high as five-hundred meters per second. It should be noted that the desired piston velocity is a parameter adjustable in correspondance with the desired jet velocity, the shape of the nozzle, the area ratio of the nozzle and so forth. That rapid valving accomplished by port 40 and openings 42 is essential to proper functioning.

From the specific embodiment shown in FIG. 7, there are a number of possible alternatives. The fluids employed to accelerate launch tube 30 and subsequently to arrest its forward motion and provide for its rearward acceleration may be either hydraulic liquids or compressed gases. In addition, all of those actions may be achieved by other mechanical or electro-mechanical means. The high-pressure gas used to accelerate the piston and liquid package may be simply compressed air, up to about three-hundred bar, or may be the hot gaseous products of a controlled chemical reaction. Such a chemical reaction may include the deflagration of a fuel-air or fuel-oxygen mixture, the injection and ignition of a liquid fuel such as kerosene or deisel oil into the reservoir volume or the burning of appropriate other liquid or solid propellant in a reservoir or the like. In all cases which involve some sort of chemical reaction, the reservoir volume could be significantly smaller than required for a simple compressed-gas system. In addition, means may be provided for replentishing any type of air/oxygen mixture in the reservoir or for introducing a combustible gas, liquid or solid fuel and igniting the same at the appropriate instant.

It is emphasized that, in any event, the final gas pressure employed to accelerate piston 34 may be varied between successive cycles of the device, so as to provide varying piston velocities and consequent jet velocities. This is illustrated by the alternative inclusion of variable-pressure gas source 58. Thus, the final jet velocity at the completion of any cycle is controllable in such a way as to provide the optimum cutting or breaking of the material being worked as has been noted to be desirable by Young (1977).

For certain applications, such as where the total length but not the total weight of the generator is important, it is desirable to construct the device so as to have a very large ratio of the entrance to exit cross-sectional areas of the nozzle. In this case, the velocity required for the piston and jetting liquid package is considerably lower (less than one-hundred meters per second) than would be required for the device of FIG. 7. That lower piston velocity permits substantially different dimensioning in the construction of the generator as shown in the device of FIG. 8.

Figure 8:
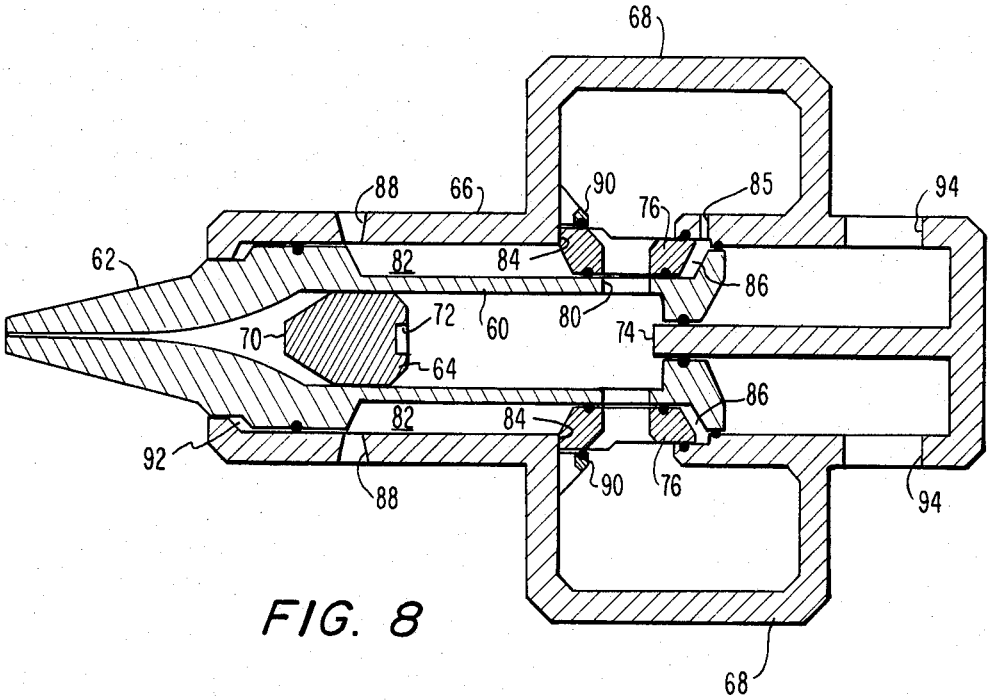
FIG. 8 is a similar view of an alternative embodiment of the device.

The general manner of operation and the features of overall importance of the device of FIG. 8 are identical to those discussed above with respect to FIGS. 1 through 7. Again, there is a launch tube 60 formed integrally with a nozzle block 62, and a piston 64 is slideable within launch tube 60. In turn, tube 60 and nozzle block 62 are slideable within an acceleration tube 66 on which is conveniently located a high-pressure gas reservoir 68. In this case, the area ratio of nozzle 62 is greater than one hundred to one.

Because of the lower velocities required, launch tube 60 has a much shorter length and a much lower ratio of length to diameter than a high-velocity device such as that in FIG. 7 requires for a comparable liquid jet energy output. In the case of FIG. 8, a typical inside diameter for tube 60 is in a range between about one-hundred and two-hundred millimeters, while the acceleration distance for piston 64 is between about fifty and one-hundred centimeters. Due to its larger mass and diameter and lower peak velocity, piston 64 preferably incorporates a tapered nose 70 in order to reduce the amount of water or other jetting liquid required. On the rear of piston 64 is a locking unit 72 which holds piston 64 in its rearward position during the forward acceleration of nozzle 62 and tube 60. A central shaft 74 passes through the rear of tube 60 in order to mate and lock with locking unit 72. The locking device may be either mechanical, magnetic or electromagnetic, but a frictional type locking device with a pressure-sensitive release is preferred as being the most practical.

A significant modification in FIG. 8, made easily available because of the large dimensions and lower velocities, involves the inclusion of a sliding-valve mechanism 76. When launch tube 60 arrives at its forward position, valve 76 serves as a port from reservoir 68 which is aligned with openings 80 near the rear end of tube 60 for admitting the high-pressure gas at the proper point in the cycle. Sliding action of valve 76 serves to introduce the high-pressure reservoir gas into a forward acceleration chamber 82 by means of a valve opening at 84 when valve 76 slides laterally in the manner provided and as shown with valve opening 84 closed. That is, opening action is effected by the rearward movement of launch tube 60 at the end of its rearward travel. Opposite opening 84 is a port 85 which leads to a chamber 86 defined at the rear of Valve 76. Valve 76 moves at the respective ends of the motion stroke of the launch tube. Whether valve 76 is opened or closed is controlled by the pressures acting in chambers 82 and 86 which, in turn, are controlled by the relative position of launch tube 60.

As tube 60 moves forward, pressure is increased in chamber 86, because of its reduced volume and by reason of the admission of gas through controlled-flow orifice 85. The pressure is reduced in chamber 82 because of its volume increase and eventually the escape of gas by way of exit ports 88 near the forward end of accelerating tube 66. Sliding valve 76 is guided by both launch tube 60 on its interior and an annular guiding collar 90 on its exterior. Collar 90 contains passages which are dimensioned to provide the appropriate delivery of gas under pressure to chamber 82 for the forward acceleration until, finally, the closing of valve 76 due to the increasing pressure in chamber 86.

Another feature of interest in FIG. 8 is the manner in which the residual piston-launching gas is used to drive the return cycle. Once the pressure in chamber 82 is vented through port 88, the return cycle is started by the high-pressure gas which at that point has just been compressed in chamber 86, and that gas in this case preferably is assisted by the application of a high-pressure gas or liquid into a forward-motion-arrest chamber 92. Additional assistance is in this case given by the bleeding of a small amount of the gas from reservoir 68 into chamber 86 through port 85. For the same reasons, small passages may extend from tube 60 directly into chamber 86; they are sufficiently small as to not effect forward motion of the piston. As a result of the initial travel of launch tube 60 in a rearward direction, openings 80 in the launch tube become aligned with return-cycle chamber 86, resulting in the introduction of the residual gas behind piston 64 into chamber 86 in order further to provide a driving force for the return cycle. Exhaust ports 94 to the rear of tube 60 are dimensioned and positioned so that the inertia of the nozzle and launch tube unit is adequate to complete the return cycle, once pressure is lost in chamber 86.

With the device of FIG. 8, the low-velocity high area ratio jet generator also is capable of having the reservoir gas pressure varied from cycle to cycle in order to vary the peak velocity and energy in the emitted liquid jet pulses. Although the velocities experienced by all components are lower for the embodiment of FIG. 8, the distance that those components must travel are less and, therefore, the characteristic times for the various operations occuring within a complete cycle are comparable to those for the high-velocity device. Consequently, the lower-velocity generator of FIG. 8 also can be operated at frequencies of up to two cycles per second.

In both FIGS. 7 and 8, seals have been indicated between different ones of the adjacent moving parts. With sufficiently-high tolerences, these may be eliminated because of the rapid speeds employed. If used, they should be hard seals.

Rock breakage data published in the aforementioned 1977 Young article indicate that around one liter of granite rock may be removed for every four jet impacts at a piston energy of 10,000 Joules and with a specific energy of forty Joules per cubic centimeter. Taking four seconds per four input cycles, a single oscillating jet generator is able to break out fifteen liters of rock per minute or nine-hundred liters per hour. On a 24-hour schedule at sixty-four percent operating efficiency, a three meter diameter tunnel thus may be advanced one meter per day. That is, when coupled with the rock breakage techniques discussed in the aforementioned Young (1977) reference and the Swedish patent, the oscillating pulse jet generators herein described offer a tunnel driving capacity, for a tunnel with a three meter diameter, of one meter per day per generator. By reason of the compactness of these generators, several units could be allowed to work simultaneously. That permits the achievement of commercially-viable tunneling rates.

While particular embodiments of the invention have been shown and described, and various alternatives and modifications have been taught, it will be obvious to those of ordinary skill in the art that changes and other modifications may be made without departing from the invention in its broader aspects. Therefore, the aim in the appended claims is to cover all such changes and modifications as fall within the true spirit and scope of that which is patentable.

I claim:

1. A device for generating high-energy pulsed water jets by means of an unsteady acceleration process:

an accelerating means;

a launch tube;

a cumulative-type nozzle carried by and movable with said launch tube with respect to said accelerating means;

a piston wholly contained by and slidable within said launch tube;

means for initiating a liquid package within said launch tube in front of said piston, and establishing a transient hydrodynamic seal of the nozzle tip and a temporary (transient) partial vacuum within said launch tube between said piston and nozzle to ingest a predetermined amount of liquid within said launch tube and substantially empty said nozzle;

means for rapidly accelerating said launch tube and nozzle in a forward direction while said piston and said package, by reason of their inertia, remain substantially fixed in space and become located in a position to be subsequently driven by a high-pressure gas forwardly toward said nozzle;

and means for driving said piston and liquid package toward said nozzle upon reaching said position.

2. A device as set forth in claim 1 wherein said forward acceleration of said launch tube and nozzle and said partial vacuum created thereby within said launch tube enable the introduction of additional liquid for said liquid package through the exit orifice of said nozzle.

3. A device as set forth in claim 1 wherein said launch tube has a rear end and said piston has a rear both relative to said forward direction and which further includes an opening located near the rear end of said launch tube and a high-pressure gas reservoir having a port, said forward acceleration of said launch tube and nozzle serving, at the end of the forward motion under said forward acceleration, to align said opening with said port, thereby providing access of said gas from said reservoir into said launch tube and to the rear of said piston and causing a rapid forward acceleration of said piston and said water package toward said nozzle.

4. A device as set forth in claim 3 wherein movement of said launch tube and nozzle to a rearward position within said device serves to close said port, thus preserving residual high-pressure gas within said reservoir, and also serves to expose said opening to the atmosphere, thereby permitting residual high-pressure gas within said launch tube to escape.

5. A device as set forth in claim 4 which includes means for varying the pressure of said gas maintained in said reservoir between successive cycles of a series of operations of said device.

6. A device as set forth in claim 1 wherein said high-pressure gas is developed by a process of combustion.

7. A device as set forth in claim 1 wherein the area ratio of said nozzle is greater than one hundred to one, and wherein the velocity of travel of said piston is correspondingly selected.

8. A device as set forth in claim 7 which further includes a sliding valve adjacent to and in communication with said reservoir and means for operating said valve to enable an automatic forward acceleration of said nozzle and launch tube under the force of high-pressure gas from said reservoir.

9. A device as set forth in claim 7 wherein residual gas pressure remaining in said launch tube after the rapid forward acceleration of said piston is used to drive the rearward, relative return cycle of said nozzle and launch tube by means of response to said residual gas pressure.

10. An oscillating pulsed jet generator comprising:

an accelerating means;

an elongated launch tube;

a cumulative-type nozzle coupled to one end of said launch tube and projecting away from one end of said launch tube, said launch tube being closed at its other end, said launch tube and said nozzle being movable with respect to said accelerating means;

a piston slidable longitudinally of and wholly within said launch tube;

an elongated accelerating tube ensleeving said launch tube and accommodating limited slidable movement of said launch tube and nozzle therewithin;

a reservoir of a gas under a pressure sufficiently high to accelerate said piston forwardly within said launch tube toward said nozzle;

valve means for selectively admitting said gas into said launch tube on the side of said piston opposite said nozzle when said piston is in a predetermined position rearwardly within said launch tube;

means for moving said launch tube and said nozzle within said accelerating tube to position said piston in said predetermined rearward position;

and said piston being accelerated by said accelerating means after completion of said rearward movement of said launch tube.

* * * * *